United States Patent [19]

Takai

[11] 4,408,541

[45] Oct. 11, 1983

[54] BOGIE TRUCK CAR BODY SUPPORT SYSTEM

[75] Inventor: Hideo Takai, Hikari, Japan

[73] Assignee: Hitachi, Ltd., Tokyo, Japan

[21] Appl. No.: 272,262

[22] Filed: Jun. 10, 1981

[30] Foreign Application Priority Data

Jun. 11, 1980 [JP] Japan ..... 55-77739

[51] Int. Cl.[3] ..... B61F 5/00

[52] U.S. Cl. ..... 105/199 R; 105/200; 105/202; 267/3; 267/63 R

[58] Field of Search ..... 105/199 R, 199 F, 199 CB, 105/202, 197 B, 200, 171, 174, 210, 182 R; 308/136, 137, 138; 267/57.1 R, 3, 57.1 A, 63 R, 63 A; 248/605, 632, 634, 583

[56] References Cited

U.S. PATENT DOCUMENTS 3,121,402 2/1964 Julien ..... 105/199 F

FOREIGN PATENT DOCUMENTS 1138087 8/1957 Fed. Rep. of Germany ... 105/199 R 2038744 7/1980 United Kingdom ..... 105/199 R

OTHER PUBLICATIONS

*The Car and Locomotive Cyclopedia,* Fourth Edition, Simmons-Boardman Publishing Corp., 1980, p. 16.

*Primary Examiner*—Robert B. Reeves
*Assistant Examiner*—Richard Mathieu
*Attorney, Agent, or Firm*—Antonelli, Terry & Wands

[57] ABSTRACT

A bogie truck car body support system wherein a car body is directly supported on a truck frame by bolster springs, the system including a link arranged longitudinally of the car body and connected at one end to a link support which is fixed to the car body by a play-free shock absorber and at the other end to a pin through a play-free shock absorber and a bush rotatably fitted on the pin. The car body has neither the bush nor center pin directly connected thereto which might become wobbly. The system can be readily assembled and disassembled and is capable of reducing vibration and noise transmitted from the truck to the car body.

4 Claims, 7 Drawing Figures

BOGIE TRUCK CAR BODY SUPPORT SYSTEM

BACKGROUND OF THE INVENTION

1. Field of the Invention

This invention relates to a bogie truck car body support system without a swing bolster, wherein a car body is supported on a truck frame through bolster springs accommodating horizontal displacements of the car body and a track and transmission of forces longitudinally of the car body is effected by linking means accommodating vertical and horizontal displacements of the car body and truck.

2. Description of the Prior Art

A prior art truck type car body support systems will be described by referring to FIGS. 1–4. As shown, the numeral 1 designates an axle having an axle box 2 mounted at either end thereof. A truck frame 4 is supported on the axle boxes 2 of the axle 1 through axle springs 3. The numeral 5 designates an air spring constituting a bolster spring of low transverse rigidity. A car body 6 is supportedd on the truck frame 4 through the air springs 5. A center pin 7 is connected at its upper end to the undersurface of the car body 6 in a position which corresponds to the center of the truck frame 4 and inserted at its lower end in the truck frame 4. A rubber stopper 8 is mounted on the edge of an opening formed in the truck frame 4 for receiving the center pin 7, to support the car body 6 through the center pin 7 when there are relatively large transverse displacements between the truck and the car body 6. A link 9, provided at opposite ends with rubber bushes 10, is connected at one end to a center pin support 11 through the rubber bush 10 and at the other end to a link support 15 through the rubber bush 10. The center pin support 11 is fitted over the center pin 7 through a bush 16, and the link support 15 is attached to the underside of the truck frame 4. Rotary movement between the truck and car body 6 is accommodated by a sliding section between the bush 16 and center pin 7. The numeral 12 designates a holding member for supporting the bush 16 for rotation relative to the center pin 7, the holding member 12 being mounted on the center pin 7 through a nut 13 fitted on a bolt at the lower end of the center pin 7.

In the aforesaid construction, longitudinally acting forces acting on the center pin 7 at acceleration and deceleration are transmitted to the truck frame 4 through the center pin supports 11, rubber bushes 10, links 9 and link supports 15. At this time, the car body 6 and truck vibrate back and forth and are relatively displaced both vertically and transversely, causing the links 9 to be inclined. However, the pinching movement of the links 9 is absorbed by the bushes 10. Rotary movements of the car body 6 and the truck are accommodated by rotary movements of the center pin 7 and the center pin supports 11.

Some disadvantages are associated with the aforesaid construction. For example, since rotary movements of the center pin 7 and center pin supports 11 are accommodated by sliding movement of the center pin 7 with respect to the bush 16, there is a slight clearance between the center pin 7 and bush 16. Thus the center pin 7 wobbles in the clearance when the center pin supports 11 vibrate during traveling movement of the car body 6 and unpleasant noise is produced as the vibration is transmitted through the center pin 7 to the car body 6, thereby reducing the riding comfort of passengers.

Proposals have been made to minimize the clearance between the center pin 7 and bush 16 and to use a rubber bush for the bush 16 to prevent the center pin 7 from wobbling. However, wear is caused on the center pin and bush with year and wobbling is inevitable. In addition, the use of a rubber bush suffers the disadvantages that the construction becomes complex and difficulties are experienced in assembling and disassembling the car body 6 and truck.

SUMMARY OF THE INVENTION

This invention has been developed for the purpose of obviating the aforesaid disadvantages of the prior art. Accordingly the invention has as its object the provision of a bogie truck car body support system that does not have a swing bolster, wherein a pin and bushes that can readily be attached and detached are used and means is provided for avoiding the production of a rattling noise that might be caused by wobbling of the pin and bushes and transmitted to the car body.

The outstanding characteristic of the invention is that a longitudinally extending link is secured at one end thereof through a playfree bush to a link support mounted on a car body without directly connecting a center pin to the car body and has, at the other end thereof, a pin bush which is connected, with plug, through a rubber bush. Stated differently, no pin and bushes having play are directly connected to the car body, so that the system is characterized by the ease with which assembling and disassembling can be effected and the difficulty with which a rattling noise is transmitted to the car body.

DESCRIPTION OF THE PREFERRED EMBODIMENT

Figure 1:
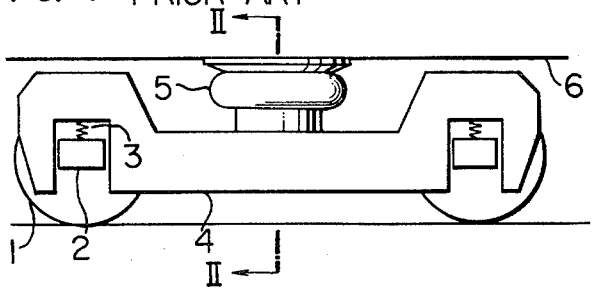
FIG. 1 PRIOR ART
FIG. 1 is a sectional view of a truck portion of a car body provided with a prior art truck.
Figure 2:
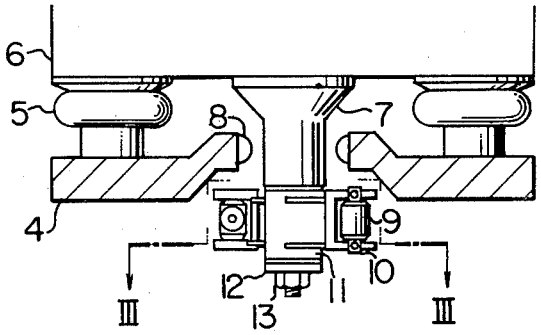
FIG. 2 PRIOR ART
FIG. 2 is a sectional view as seen in the direction of arrows II—II in FIG. 1.
Figure 3:
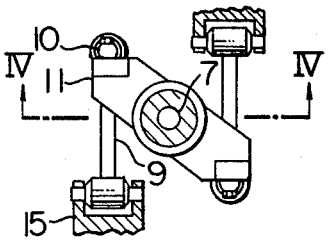
FIG. 3 PRIOR ART
FIG. 3 is a sectional view as seen in the direction of arrows III—III in FIG. 2.
Figure 4:
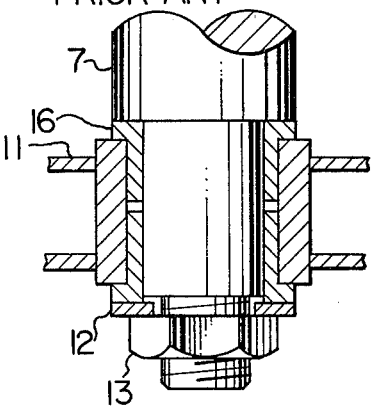
FIG. 4 PRIOR ART
FIG. 4 is a sectional view, on an enlarged scale, as seen in the direction of arrows IV—IV in FIG. 3.
Figure 5:
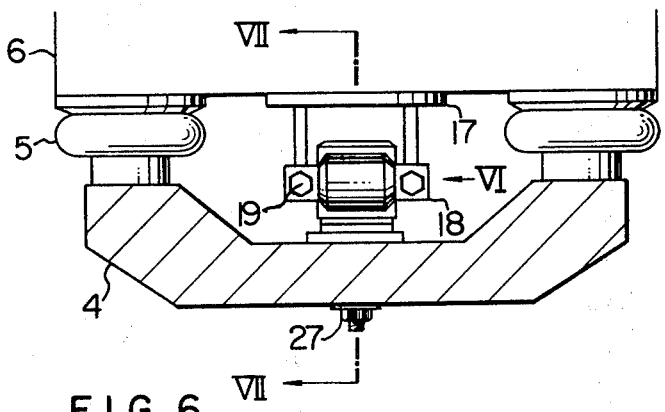
FIG. 5 is a transverse sectional view of a car body as viewed in the same direction as FIG. 2 having the car body support system according to the invention.
Figure 6:
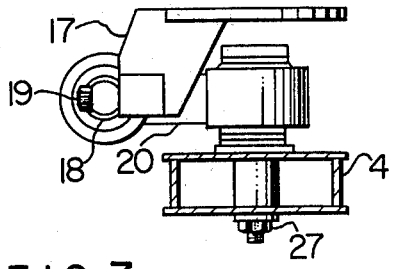
FIG. 6 is a view as seen in the direction of arrow VI in FIG. 5.
Figure 7:
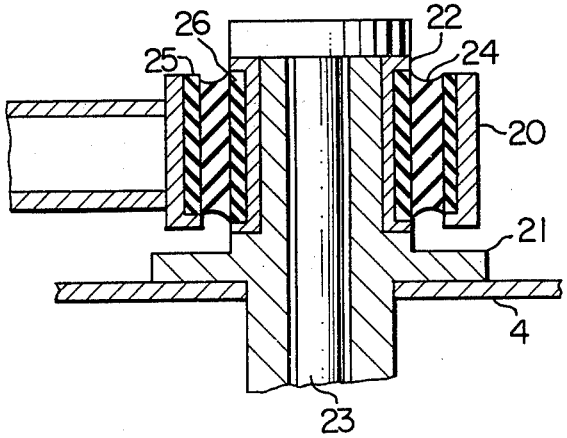
FIG. 7 is a sectional view, on an enlarged scale, as viewed in the direction of arrows VII—VII in FIG. 5.

A preferred embodiment of the invention will now be described by referring to FIGS. 5–7 wherein parts similar to those shown in FIGS. 1–4 are designated by like reference characters. The numeral 7 designates a link support attached to the underside of the car body 6 in a position corresponding to the central portion of the truck frame 4. A longitudinally extending link 20 is secured to the link support, through a rubber shock absorber 18, by bolts 19. The rubber shock absorber 18 is formed by vulcanizing and bonding rubber between an inner cylinder and an outer cylinder, the inner cylinder being secured to the link support 17 by the bolts 19 and the outer cylinder being force fitted over the link 20, so that there is no sliding movement between the components which are, thus, free from play. A center pin 21 is connected to the center of rotation of the truck frame 4 and has rotatably mounted on its upper portion a bush 22 having a rubber inner cylinder 26 of a rubber shock absorber 24 fitted over its outer periphery. The numeral 23 designates a special bolt for preventing dislodging of the bush 22 from the center pin 21 axially thereof, which extends through the center pin 21 and is clamped by a nut 27 at its lower end to hold the bush 22 in place. The shock absorber 24 is formed by vulcanizing and bonding rubber between the rubber inner cylinder 26 and a rubber outer cylinder 25 force fitted to the other end of the link 20 opposite to the end thereof having the bush 18 as aforesaid.

In this construction, relative rotary movements of the truck and car body 6 are accommodated by rotation of the link 20 relative to the center pin 21 by way of bushing 22 rotatably mounted on pin 21. Longitudinally directed forces are transmitted through the link support 17, link support 20 and center pin 21, and transverse displacements are accommodated by the shock absorbers 18 and 24.

In this construction, two shock absorbers, of the shock absorbers 18 and 24, are interposed between the car body 6 and the center pin 21 having the bush 22 rotatably mounted thereon. By this structural feature, any sound or vibration produced by wobbling of the parts can be damped by shock absorbers and their transmission to the car body 6 can be avoided, thereby enabling noise of vibration transmitted to the car body to be greatly reduced. When it is desired to detach the truck from the car body 6, the bush 22 and special bolt 23 can be moved upwardly together with the link 20 and rubber bush 24 merely by loosening the nut 27, thereby enabling disassembling to be effected readily. The truck can be assembled with the car body 6 by reversing the aforesaid process. Another feature of the invention is that the use of a single link enables the links and shock absorbers to be reduced in number as compared with systems of the prior art, thereby enabling the construction to be rendered less complex.

From the foregoing description, it will be appreciated that the invention enables vibration and noise transmitted to a car body to be greatly reduced and improves riding comfort of passengers. At the same time, assembling and disassembling of a truck with a car body can be facilitated. Also, the number of parts, such as links and bushes, etc., can be reduced as compared with the prior art.

What is claimed is:

1. A bogie truck car body support system, wherein a car body is supported on a truck frame through air springs of low transverse rigidity, comprising:

a link support attached to a portion of the underside of the car body which corresponds to a central portion of the truck frame;

a center pin mounted on the central portion of the truck framing with its longitudinal axis oriented vertically;

a link arranged longitudinally of the car body, one end of said link being connected to said link support by a first connecting means capable of transmitting longitudinally directed forces between the car body and the truck frame and accommodating relative vertical, transverse and rotary movements of the car body relative to the truck frame; and the other end of said link being detachably connected to the center pin by a second connecting means capable of transmitting longitudinally directed forces between the car body and the truck frame and accommodating relative vertical and transverse movements of the car body and the truck.

2. A system as claimed in claim 1, further comprising a bolt extending axially through said center pin and having a nut fitted thereon at a lower end of the link so as to securedly hold the center pin in place on the center pin.

3. A system as claimed in claim 1, wherein said first connecting means comprises a rubber shock absorber fitted between the one end of the link and a horizontal member secured to said link support, and said second connecting means comprises a bush rotatably fitted on said center pin and a rubber shock absorber fitted between the outside of said bush and said other end of the link.

4. A system as claimed in claim 3, further comprising a bolt extending axially through said center pin and having a nut fitted thereon at a lower end of the center pin so as to securedly hold the bush in place on the center pin.

* * * * *